US007806384B2

(12) United States Patent
Doyle

(10) Patent No.: US 7,806,384 B2
(45) Date of Patent: Oct. 5, 2010

(54) LIFT WITH LOW PROFILE ROTATABLE COUPLING

(75) Inventor: James E. Doyle, Grandville, MI (US)

(73) Assignee: Suspa Incorporated, Grand Rapids, MI (US)

( * ) Notice: Subject to any disclaimer, the term of this patent is extended or adjusted under 35 U.S.C. 154(b) by 256 days.

(21) Appl. No.: 11/853,366

(22) Filed: Sep. 11, 2007

(65) Prior Publication Data

US 2009/0065752 A1 Mar. 12, 2009

(51) Int. Cl.
*B66F 3/26* (2006.01)

(52) U.S. Cl. ..... 254/93 R; 269/32; 254/89 H; 92/117 A; 108/50.2

(58) Field of Classification Search ..... 254/93 R, 254/89 H, 93 L; 269/32, 24–27; 92/117 A; 108/50.2
See application file for complete search history.

(56) References Cited

U.S. PATENT DOCUMENTS 2,795,934 A * 6/1957 Jenkins ..... 405/300
3,150,853 A * 9/1964 Lisbin ..... 248/188.4
5,553,550 A 9/1996 Doyle
5,620,067 A 4/1997 Bauer et al.
5,761,785 A * 6/1998 Connolly ..... 29/249
5,787,792 A 8/1998 Illgner
5,915,674 A 6/1999 Wolf et al.
6,113,086 A * 9/2000 Yonezawa ..... 269/24
6,305,667 B1 * 10/2001 Heller ..... 254/93 R
6,352,037 B1 * 3/2002 Doyle ..... 108/20
6,360,675 B1 3/2002 Jones
6,711,985 B1 * 3/2004 Doyle ..... 92/117 A
7,243,907 B2 * 7/2007 Singh et al. ..... 254/423

OTHER PUBLICATIONS

Ergonomix of Sweden, *Leg Cylinder C01, C06 and C07* literature, 2000.
Monarch Dyna-Lift® Group "Ergonomic Height Adjustable Systems" prior art literature.

* cited by examiner

*Primary Examiner*—Lee D Wilson
(74) *Attorney, Agent, or Firm*—Price, Heneveld, Cooper, DeWitt & Litton, LLP

(57) ABSTRACT

A lift includes a housing for rotatably receiving a hydraulic cylinder with a piston rod coupled to a generally cylindrical support tube. A low profile connecting head for supplying hydraulic fluid to the cylinder is rotatably mounted to the housing but captively held to the housing in the axial (longitudinal) direction. This allows the connecting head to be rotated during installation of the lift to a table leg for easy coupling to the pressurized source of hydraulic fluid.

14 Claims, 3 Drawing Sheets

LIFT WITH LOW PROFILE ROTATABLE COUPLING

BACKGROUND OF THE INVENTION

The present invention relates to a hydraulic lift system for use in connection with adjustable work surfaces and particularly to a rotatable coupling to facilitate installation.

As the work place environment changes with technology, so too do the facilities employed by companies to provide ergonomically appropriate work stations for technical, clerical, and assembly personnel. To accommodate different job tasks, frequently it is desirable to have a work surface or table which is vertically adjustable, such that the work surface can be employed by individuals of different stature and individuals in a standing position, a sitting position on a chair, or in an intermediate position when using, for example, a stool-height seat.

There exists numerous adjustable table assemblies which are either mechanically controlled by screw jack mechanisms or which are electrically controlled screw jacks. Some installations employ hydraulic cylinders with a pump for pressurizing fluid from a master cylinder to slave cylinders mounted within hydraulic lifts secured to the legs of a table for controlling the vertical adjustment of the work surface. One such system is commercially sold by Suspa Incorporated under the trademark MOVOTEC®, which includes a hydraulic support tube assembly for each table leg. Each support tube assembly including an outer housing, a support tube extendable from the housing and an inner hydraulic cylinder which is coupled between the outer housing and support tube and includes a piston rod which extends and retracts for raising and lowering the support tube for extending and retracting the support tube from the housing. U.S. Pat. No. 6,711,985 discloses an improved sealed glide adapter used with such system. The disclosure of U.S. Pat. No. 6,711,985 is incorporated herein by reference.

The hydraulic cylinder in the '985 patent disclosure is locked against rotation by a connecting head that includes an upper annular offset section which engages the keeper pins holding the cylinder within the support tube. Upon installation of the lift, it is necessary to align the hydraulic supply tube with respect to the table and source of pressurized fluid employed to actuate the lift. Since the hydraulic cylinder is prevented from rotation and the support tube is secured to the table leg, this installation can become difficult and may require the undesirable use of additional coupling elbows or flexible tubing. Also, typically space above a cylinder lift is limited so that mounting a standard hydraulic coupling is difficult.

Thus, there exists a need to overcome these problems and provide a hydraulic cylinder with a sealed glide adapter and which has a compact, low profile connecting head which can be rotated to facilitate installation to an existing table leg.

SUMMARY OF THE INVENTION

The system of the present invention solves this problem by providing a unique connecting head for a cylinder which includes a housing for rotatably receiving a hydraulic cylinder with a piston rod coupled to a generally cylindrical glide adapter. The connecting head for supplying hydraulic fluid to the cylinder is compact and rotatably mounted to the housing but captively held to the housing in the axial (longitudinal) direction. This allows easy access to the connecting head, which can also be rotated during installation of the lift to a table leg for easy coupling to the pressurized source.

In a preferred embodiment of the invention, the cylinder includes a sealed glide adapter comprising a generally cylindrical member having an axially extending threaded aperture formed through one end for receiving a threaded adjustable glide. In one preferred embodiment, a cylindrical recess is formed in the glide adapter at an opposite end and includes an undercut recess for snap-receiving a resilient polymeric cylindrical seal which includes an annular groove for receiving an O-ring extending between the outer surface of the seal and the inner cylindrical surface of the glide adapter. The seal includes a blind aperture for receiving one end of the piston rod of the hydraulic cylinder.

With such construction, therefore, the lifts for a table can be secured to the table legs and the supply lines of hydraulic fluid easily trained to the source by rotating the low profile connecting head. These and other features, objects and advantages of the present invention will become apparent upon reading the following description thereof together with reference to the accompanying drawings.

DETAILED DESCRIPTION OF THE PREFERRED EMBODIMENT

Figure 1A:
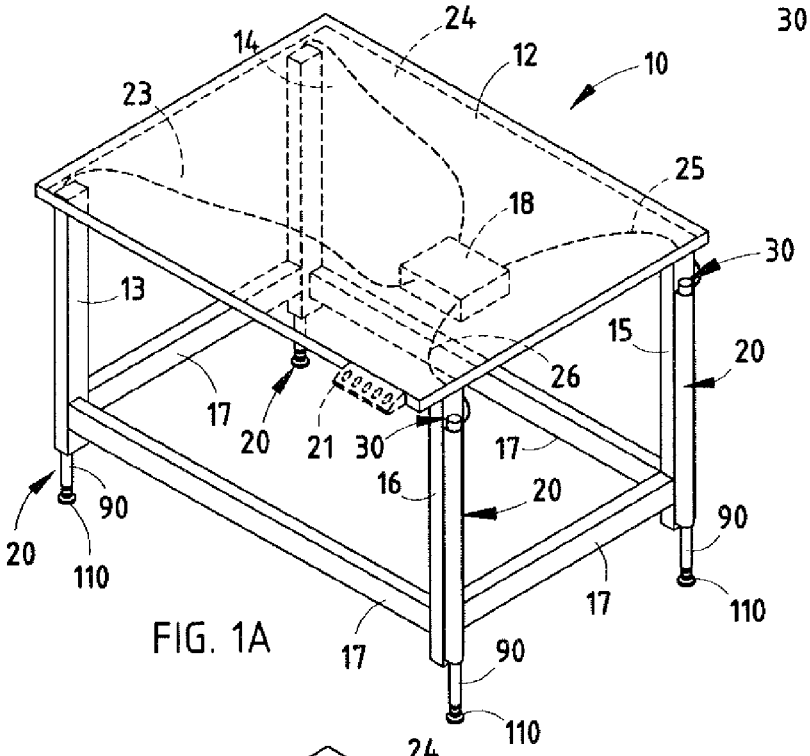
FIG. 1A is a perspective view of a work surface shown in a lowered position and including a support tube embodying the present invention attached to each of its legs.
Figure 1B:
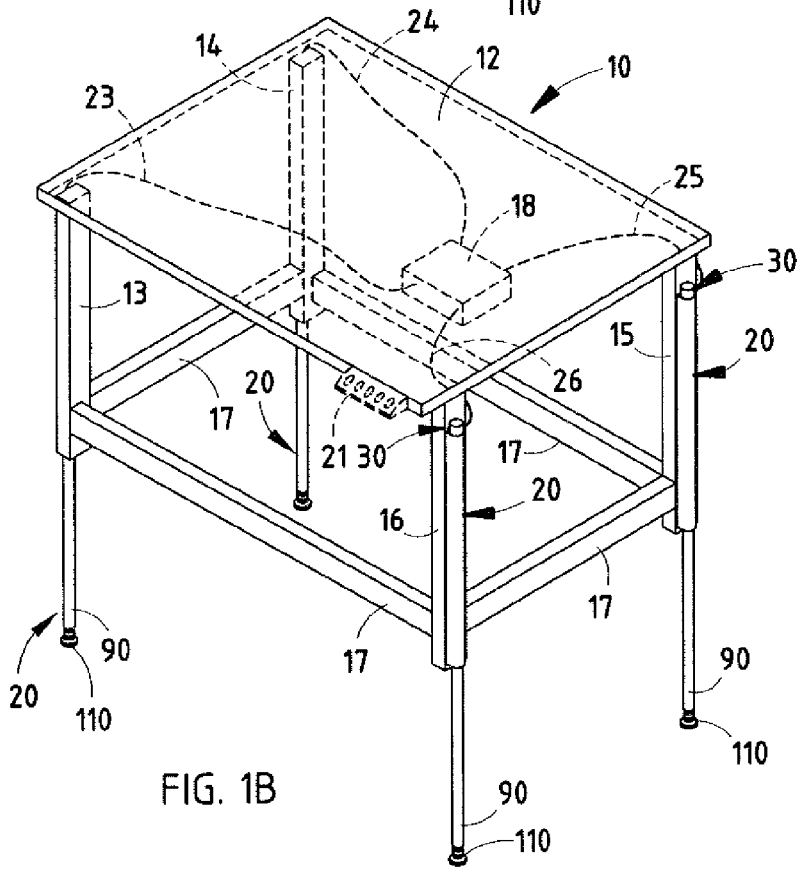
FIG. 1B is a perspective view of the work surface shown in FIG. 1A, shown in an elevated position.
Figure 2:
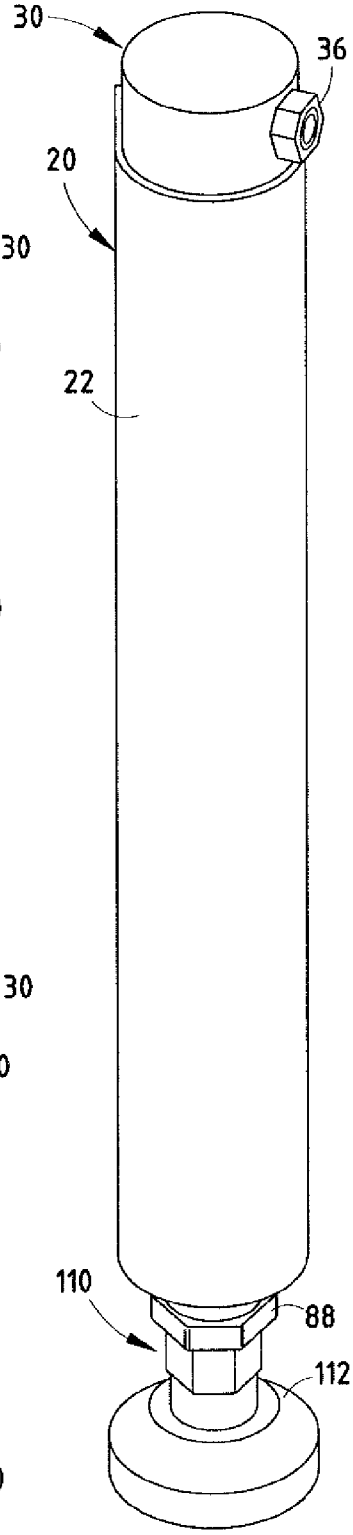
FIG. 2 is a perspective view of one of the lifts of the present invention.

Referring initially to FIGS. 1A and 1B, there is shown a table 10 having a horizontally extending work surface 12 supported by four downwardly depending legs 13-16, which are stabilized by cross members 17 coupled to the legs near the lower ends thereof. Secured to each of the legs is a hydraulic lift 20 embodying the present invention. Lifts 20 are secured to the legs by conventional fasteners extending through the legs 13-16 and threaded into flat side 27 of the housing 22 (FIGS. 2 and 3) of each of the lifts 20. The table 10 includes a hydraulic pump 18 mounted to the undersurface thereof from which extends hydraulic lines 23-26 into each of the lifts 20 associated with the four table legs 13-16. Unit 18 can include a hand crank for manual operation or, in the preferred embodiment, includes an electrically actuated pump controlled by switches on a control panel 21. Panel 21 is mounted on the forward edge of the undersurface of work surface 12 and includes controls for selectively controlling unit 18 for raising and lowering the work surface 12 as illustrated in FIGS. 1A and 1B or to any desired intermediate position and can be preprogrammed for multiple settings. In order to couple the hydraulic lines 2326 to the lifts it is desirable to align the connecting head 30 of each lift with the connecting fitting at the end of the hydraulic lines or extend the hydraulic lines directly from the lifts toward the pump 18. The use of the low profile rotatable connecting heads 30 facilitate such alignment and installation of the lifts. In installations where there is no room for minimum tubing bend radii, the low profile design of the connecting head 30 provides at least about 43 mm additional clearance for the hydraulic tubing.

Each of the lifts 20 are identical so only one such lift is now described in connection with FIGS. 3-6. Lifts 20 each includes a connecting head 30 which is rotatably coupled to the upper end of housing 22. Connecting head 30 is sealably coupled by an o-ring 38 (FIG. 4) to the upper end of a hydraulic cylinder 40 having a piston 50 which is in sealed communication with a fluid channel 35 in connecting head 30. Thus, hydraulic fluid pressure is applied through a suitable hydraulic connection such as the threaded coupling 36 extending at right angles to the longitudinal axis of cylinder 20, to one of the lines 23-26 shown in FIG. 1. The pressure is applied to a piston 50, which is coupled by piston rod 60 to the sealed glide adapter assembly 70 which, in turn, is lockably coupled to the support tube 90. Support tube 90 is slideably positioned and supported within housing 22, in part, by a support tube sleeve bushing 100. A threaded adjustable glide 110 is inserted into a glide adapter 80 included in assembly 70 such that, as fluid pressure is applied to the upper end of piston 50, piston rod 60 extends and retracts from the cylinder 40 extending and retracting the support tube 90 from the lift, as seen in FIGS. 1A and 1B.

The annular space 120 (FIG. 4) between the piston rod 60 external to hydraulic cylinder 40 and the inner surface 92 of support tube 90 is sealed at its lower end such that any loss of hydraulic fluid from cylinder 40 over a period of use will not be capable of seeping through the lower end of lift 20 due to the unique design of the sealed glide assembly 70. Having briefly described the overall components of the lift 20, a detailed description now follows in conjunction with FIGS. 3-5.

Figure 3:
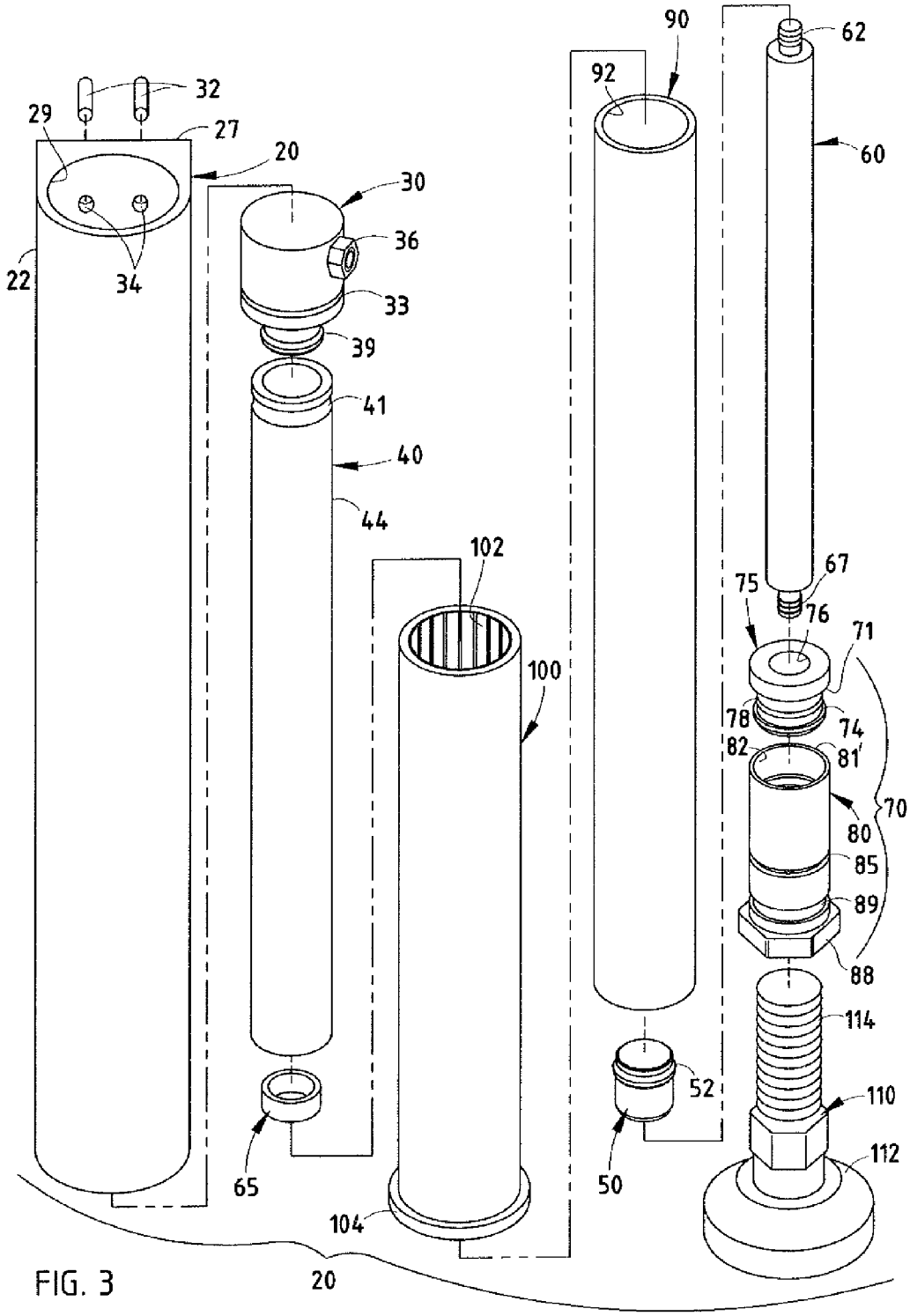
FIG. 3 is an exploded perspective view of the components of the lift shown in FIGS. 1 and 2.
Figure 4:
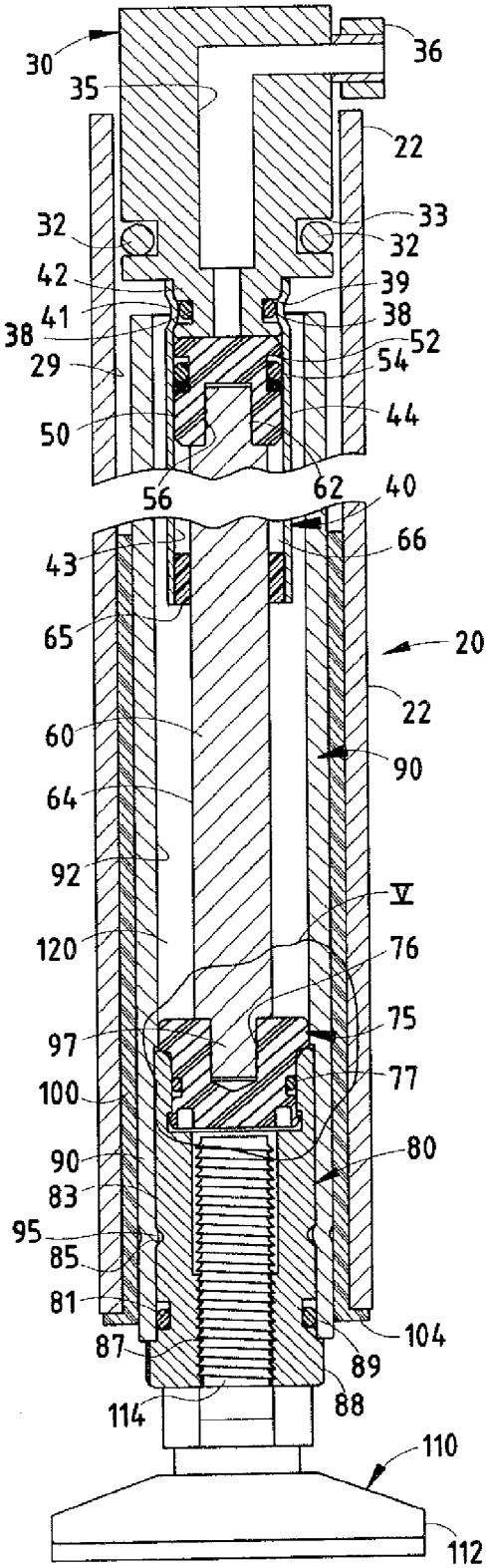
FIG. 4 is a vertical cross-sectional view of the lift shown in FIGS. 1-3, partly broken away.

As seen in FIGS. 3 and 4, the housing 22 for lift 20 includes a generally cylindrical, longitudinally extending opening 29 extending along its length for receiving the components of the lift including the hydraulic cylinder 40, support tube sleeve bushing 100, support tube 90, piston rod 60, and the sealed glide adapter assembly 70. The exterior of housing 22 includes at least one flat surface 27 (FIGS. 2 and 3), which is positioned against one of the flat table legs 13-16 and which includes threaded apertures (not shown) for receiving threaded fasteners extending through the table legs and securing a housing 22 to each of the table legs as seen in FIGS. 1A and 1B. The lift 20 includes a connecting head 30 which is rotatably secured to housing 22 by means of an annular groove 33 formed in the connecting head and which is held against axial movement by a pair of locking pins 32 extending through apertures 34 in housing 22 (FIG. 3). The connecting head 30 includes a central threaded, axially extending L-shaped aperture 35 for receiving a fitting 36 for sealably coupling the lift cylinder to one of the hydraulic lines 23-26. The pins 32 fit loosely within grove 33, such that the connecting head and the cylinder can be rotated to align the fitting 36 toward a supply line extending from pump 18. This facilitates the installation of the lifts 20 to the table legs 13-16.

The connecting head 30 is sealably coupled to the inner cylindrical wall of the elongated hydraulic cylinder 40 by means of an O-ring 38 (FIG. 4) positioned in an annular groove 39. The metallic cylindrical wall 44 of hydraulic cylinder 40 is crimped around its periphery at 41 to seal the upper end of cylinder 40 to the reduced diameter downwardly depending cylindrical end 42 of connecting head 30, which thereby sealably extends into the top of cylinder 40. Sealably coupled to the inner cylindrical surface 43 of cylinder 40 is a hydraulic piston 50 comprising a polymeric member which has a piston head 52 in fluid communication with the passageway 35 through connecting head 30 to receive the pressurized hydraulic fluid applied thereto. Piston 50 includes an annular groove 52 which holds an O-ring seal 54 for sealing the piston to inner wall 43 of hydraulic cylinder 40. An axial aperture 56 extends upwardly from the lower end of piston 50 and receives, in a force-fitting manner, the serrated upper end 62 of the piston rod 60 which is force-fit within aperture 56 to hold the end 62 of piston rod 60 to the piston 50. The lower end of the hydraulic cylinder 40 engages the outer cylindrical surface 64 of piston rod 60 by means of a bushing 65 which allows the piston rod to extend and retract from cylinder 40 for extending and retracting the support tube 90 as described below.

Over a period of years of use, the piston seal 54 will allow some leakage of hydraulic fluid into the annular space 66 between piston rod and inner surface 43 of cylinder 40 which can seep through the sliding bushing 65 and into the annular space 120 between the piston rod 60, cylinder 40, and inner wall 92 of support tube 90. Leaked hydraulic fluid, under the force of gravity, flows to the lower end of lift 20. The seated glide assembly 70 of the present invention prevents leakage of such fluid from the lower end of the lift.

Figure 5:
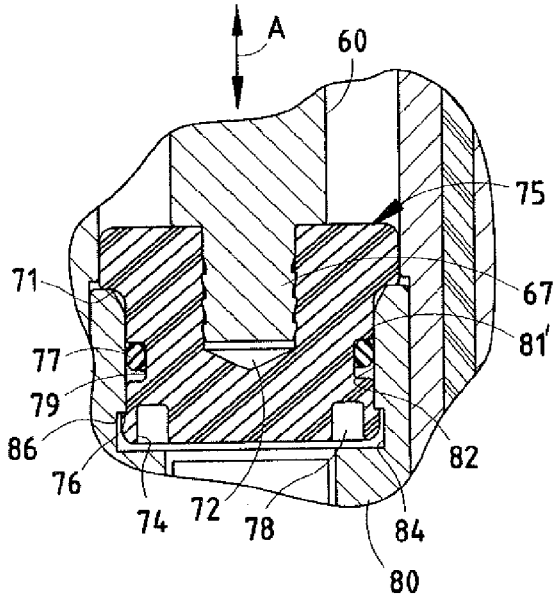
FIG. 5 is an enlarged cross-sectional view of the area V shown in FIG. 4.

The glide adapter assembly 70 includes a seal 75, which can be generally cup-shaped (FIG. 5), and a glide adapter 80, with the seal 75 being made of a polymeric material and generally cylindrical, having a central axially downwardly depending blind aperture 72 which receives in force-fitting fashion the lower serrated end 67 of piston rod 60. Seal or cap 75 is sealably and lockably secured to an inner cylindrical surface 82 in glide adapter 80, as best seen in FIG. 5, by means of an outwardly projecting annular tabs 74 of seal 75 having a latching shoulder 76 which engages undercut recess 84 in glide adapter 80. Thus, edge 76 of tabs 74 engage the horizontally extending annular surface 86 formed by undercut recess 84 to lockably hold the cylindrical seal 75 to the glide adapter 80 against movement in a longitudinal direction (indicated by arrow A in FIG. 5). To allow the flexing of tabs 74, an annular recess 78 is formed upwardly in the integrally machined seal 75 radially inside tabs 74. Seal 75 further includes a peripheral annular recess 79 for receiving a sealing O-ring 77 which seals against the inner cylindrical surface 82 of adapter 80. Thus, the seal 75 provides a physical coupling of piston rod 60 to glide adapter 80 and a sealed interconnection between glide adapter 80 and the space 120 between support tube 90 and hydraulic cylinder 40. The seal 75 includes an annular shoulder 71 (FIG. 5) which engages the upper annular rim 81' of glide adapter 80 to transmit the downward force applied by the piston rod on seal 75 to support tube 90 through glide adapter 80.

The glide adapter 80 is a machined generally cylindrical steel member and includes a central threaded aperture 87 extending therethrough (FIG. 4) having a hex-shaped lower end 88 for allowing adjustment of glide 110 as described below. Glide adapter 88 further includes an annular recess 89 which receives a sealing O-ring 81 therein for sealing the outer cylindrical surface 83 of glide adapter 80 to the inner cylindrical surface 92 of support tube 90. Support tube 90 is secured to the glide adapter 80 by means of an annular groove 85 extending around the periphery of glide adapter 80 and which receives a crimp 95 in the cylindrical wall of support tube 90. Thus, the lower end of support tube 90 is mechanically and sealably coupled to glide adapter 80.

The glide 110 includes a foot 112 and an upwardly extending threaded end 114 which is adjustably threaded into threaded aperture 87 of glide adapter 80. Glide 110 includes a hex surface 111 which, together with hex surface 88 on glide adapter 80, allows wrenches to adjust the glide for leveling the table on uneven surfaces and to provide a finite amount of final height adjustment if desired. The support tube 90 is guidably held within the cylindrical aperture 29 of housing 22 by means of a cylindrical guide bushing 100 having a longitudinally serrated inner surface 102, as best seen in FIG. 3, and an enlarged annular shoulder 104 which overlies, as best seen in FIG. 4, the lower end of housing 22. As seen in FIG. 4, the axial height of threaded section 114 of glide 110 is selected to prevent the glide from engaging seal 75.

In operation, as pressure is applied to the piston 50, rod 60 extends from cylinder 40, pushing against the connecting head 30 coupled to the housing 22 thereby pushing against seal 75 and glide adapter 80 which is coupled to support tube 90, thereby extending support tube 90 through bushing 100 outwardly from housing 22, raising the work surface 12, as illustrated in FIG. 1B. Upon release of the hydraulic pressure in cylinder 40, the support tube 90 can again retract within housing 22 as piston 60 retracts within cylinder 40. By providing the sealed glide assembly 70 of the present invention, any fluid which may leak from cylinder 40 into annular space 120 of the lift 20 is captured and prevented from escaping the lower end of the lift by means of O-ring seals 77 and 81 (FIGS. 4 and 5).

If it becomes necessary to replace hydraulic lift cylinder 40, pins 32 are removed from housing 22. Glide 110 is then removed from glide adapter 80 and a tool, such as a rod, is inserted through aperture 87 to press the cap seal 75 and attached hydraulic cylinder 40 out through the open upper end of housing 22. A new cylinder and seal can then be installed.

In a preferred embodiment of the invention, the seal 75 is screw machined from a polymeric material made of, for example, acetal, polybutylene teraphthalate, or other suitable material. The glide adapter 80 is machined of metal, such as steel, and support tube 90 can also be made of metal, such as polished aluminum, stainless steel, or the like to provide an aesthetically acceptable external wall surface appearance when extended from the housing 22 as seen in FIG. 1B. Support tube sleeve bushing 100 is also made of a lubricious polymeric material, as are piston 50 and foot 112. The remaining components typically are machined aluminum or other suitable metal for providing the desired strength and rigidity to the lift 20 so formed. The locking tab 76 on seal 75 is a continuous annular member. In some embodiments it may be desirable to provide serrations to define a plurality of arcuately spaced locking tabs.

Figure 6:
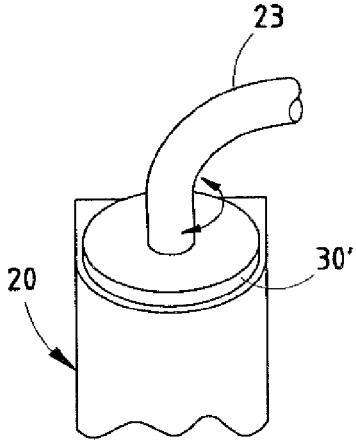
FIG. 6 is a fragmentary perspective view of an alternative embodiment of the lift of the present invention.

Instead of the right angled passageway 35 of the first embodiment described in which the fitting extends radially from the connecting head, the hydraulic lines 23-26 may be coupled directly to the top of a low profile connecting head 30' as seen in the embodiment of FIG. 6. In this embodiment, the aperture 35' extends axially through the connecting head, and an axially extending fitting 36' is coupled to the top of the connecting head to couple one of the lines 23-26 to the lift. The lines can then be trained toward pump 18 by suitably rotating the connecting heads 30'.

It will become apparent to those skilled in the art that various modifications to the preferred embodiment of the invention as described herein can be made without departing from the spirit or scope of the invention as defined by the appended claims.

The invention claimed is:

1. A hydraulic lift for coupling to a table leg comprising:

a generally cylindrical housing having a flat side for attachment to a table leg;

a connecting head including an annular recess;

a pair of pins extending through said housing and into said annular recess for rotatably coupling said connecting head to one end of said housing;

a hydraulic cylinder sealably coupled to said connecting head and including a piston and piston rod therein, wherein said piston rod extends and retracts from said cylinder from an end of said hydraulic cylinder opposite said connecting head, wherein said connecting head extends outwardly from said housing and includes an aperture coupled to said cylinder for supplying pressurized fluid thereto;

a support tube slideably mounted in said housing and coupled to said piston rod; and a glide adapter coupled to said support tube.

2. The lift as defined in claim 1 wherein said connecting head includes a threaded fitting coupled to an end of said aperture.

3. The lift as defined in claim 2 wherein said threaded fitting extends radially outwardly from said connecting head.

4. The lift as defined in claim 2 wherein said threaded fitting extends axially outwardly from said connecting head.

5. The lift as defined in claim 1 wherein said glide adapter includes a first annular recess with an O-ring sealably coupling said glide adapter to a lower end of said support tube, said glide adapter including a mechanical connection to said support tube, said glide adapter further including a cylindrical aperture formed in an upper end thereof, said cylindrical aperture including an undercut recess for receiving a seal; and a seal including an annular shoulder extending over said upper end of said glide adapter wherein said seal includes an annular recess for receiving an O-ring extending between an outer surface of said cylindrical seal and the cylindrical aperture of said glide adapter.

6. The assembly as defined in claim 5 and including a glide having a threaded end threadably extending into said glide adapter.

7. The assembly as defined in claim 6 and further including a hydraulic tube coupled between said connecting head and a hydraulic pump.

8. A hydraulic lift comprising:

a housing;

a connecting head rotatably coupled to one end of said housing;

a hydraulic cylinder sealably coupled to said connecting head and including a piston and piston rod therein, wherein said piston rod extends and retracts from said cylinder from an end of said hydraulic cylinder opposite said connecting head, wherein said connecting head extends outwardly from said housing and includes an aperture coupled to said cylinder for supplying pressurized fluid thereto;

a support tube slideably mounted in said housing;

a generally cylindrical glide adapter having a first annular recess with an O-ring sealably coupling said glide adapter to a lower end of said support tube, said glide adapter further including a mechanical connection to said support tube, said glide adapter further including a cylindrical aperture formed in an upper end thereof, said cylindrical aperture including an undercut recess for receiving a seal; and a seal including an annular shoulder extending over said upper end of said glide adapter wherein said seal includes an annular recess for receiving an O-ring extending between an outer surface of said cylindrical seal and the cylindrical aperture of said glide adapter.

9. The lift as defined in claim 8 wherein said connecting head includes a threaded fitting coupled to an end of said aperture.

10. The lift as defined in claim 9 and wherein said threaded fitting extends radially outwardly from said connecting head.

11. The lift as defined in claim 9 and wherein said threaded fitting extends axially outwardly from said connecting head.

12. The lift as defined in claim 8 wherein one side of said housing is flat.

13. A hydraulic lift comprising:

a generally cylindrical housing having a flat side for attachment to a table leg;

a connecting head extending from said cylindrical housing for coupling to a source of pressurized hydraulic fluid, said connecting head including an annular recess;

a pair of pins extending through said flat side of said housing and into said annular recess for holding said connecting head within said housing while allowing said connecting head to rotate within said housing;

a hydraulic cylinder sealably coupled to said connecting head and including a piston and piston rod therein, wherein said piston rod extends and retracts from said cylinder from an end of said hydraulic cylinder opposite said connecting head, and wherein said connecting head includes an aperture coupled to said cylinder and a threaded fitting coupled to an end of said aperture, wherein said threaded fitting extends radially outwardly from said connecting head for supplying pressurized hydraulic fluid thereto;

a support tube sealably mounted in said housing and coupled to said piston rod; and a glide adapter and slide coupled to said support tube.

14. The lift as defined in claim 13 wherein said glide adapter includes a first annular recess with an O-ring sealably coupling said glide adapter to a lower end of said support tube, said glide adapter including a mechanical connection to said support tube, said glide adapter further including a cylindrical aperture formed in an upper end thereof, said cylindrical aperture including an undercut recess for receiving a seal; and a seal including an annular shoulder extending over said upper end of said glide adapter wherein said seal includes an annular recess for receiving an O-ring extending between an outer surface of said cylindrical seal and the cylindrical aperture of said glide adapter.

* * * * *